US006121565A

United States Patent [19]

Allott, III

[11] Patent Number: 6,121,565

[45] Date of Patent: Sep. 19, 2000

[54] METHOD MANIPULATING A DELIVERY SYSTEM USING EXPIRING INDICIA

[75] Inventor: Gordon Llewellyn Allott, III, San Francisco, Calif.

[73] Assignee: ILUC, LLC, San Francisco, Calif.

[21] Appl. No.: 09/235,097

[22] Filed: Jan. 21, 1999

[51] Int. Cl.[7] ..... B07C 5/00

[52] U.S. Cl. ..... 209/584; 235/375

[58] Field of Search ..... 209/584; 235/375

[56] References Cited

U.S. PATENT DOCUMENTS 4,408,557 10/1983 Bradley .

4,903,254 2/1990 Haas .

5,107,470 4/1992 Pedicano .

5,480,032 1/1996 Pippin et al. ..... 209/583

5,930,206 7/1999 Haas .

*Primary Examiner*—Harold I. Pitts

[57] ABSTRACT

A method manipulating a delivery system using expiring indicia. An expiring indicia (1) with a manifested time (3) is placed on a delivery piece (9). The method dictates that when a delivery piece (9) is placed in a delivery stream before the manifested time (3) the delivery system will be manipulated to allow the delivery piece (9) to continue. However, if the delivery piece (9) is placed in a delivery stream after the manifested time (3) the delivery system will be manipulated to reject the delivery piece (9) from the delivery stream.

20 Claims, 3 Drawing Sheets

METHOD MANIPULATING A DELIVERY SYSTEM USING EXPIRING INDICIA

CROSS-REFERENCES

The present application is neither related to nor a continuation of any pending application or co-pending applications.

GOVERNMENT RIGHTS

The present application does not have any relation to any federally sponsored research and development.

BACKGROUND

1. Field of Invention

This invention relates to methods used in billing and delivery systems.

2. Background

Many companies conduct month to month billing for routine goods and services. For example, a telephone company sends a bill to each of its customers at the end of every billing period. Each bill describes in detail a customer's accrued charges for that month, and typically includes a courtesy pre-addressed envelope for the customer to make payment.

All billing procedures have a substantial impact on the cash flow of a company. This is due to the fact that the sooner a company receives payment for its services, the sooner it can meet obligations of its own or use the payment to earn interest. Efficiencies in billing, thus, increase revenue for billing companies.

Prior Art

Originally, billing efficiencies have been created by automation. For example, U.S. Pat. No. 5,802,498, utilizes a computer aided system to print and mail customer invoices. It also has the feature of attaching postage to a remittance envelope so the customer can conveniently deposit it in the mail.

The present invention achieves what the prior art has not been able to accomplish. This invention encourages customers to deposit a remittance envelope as early as possible. Furthermore, this invention accomplishes this task by positive reinforcement providing a reward for doing so.

Other prior art includes U.S. Pat. No. 5,832,119 which authenticates the validity of an object, such as a stamp through stenography. Another, U.S. Pat. No. 5,806,421, creates a method of printing a postage stamp directly on a delivery piece. These developments, while increasing the respective authenticity and ease with which postage is used, do not create any incentive for a customer to deposit her remittance envelope in the mail as early as possible.

OBJECTS OF THE INVENTION

Billing companies experience the time between billing and collection as an expense. This is due to the loss of the time value of the money owed but not received. If a customer paid each bill immediately upon receipt, the billing company could put that payment to work paying its own bills or accruing interest. For example, a company could take the immediate receipt of money and pay its rent or place it into an interest bearing financial instrument.

Some billing inefficiencies that delay receipt of bills are the result of billing traditions that customers expect. An example of this is the grace period, which allows customers to delay their payment to a billing company, typically for thirty days.

Inefficiencies such as grace periods force companies to further rely on short-term credit to cover resulting deficits in cash flow. Instead of paying expenses, such as rent, the billing company must use credit to pay these expenses.

Assuming a short-term credit expense of 5.4% APR (annual percentage rate), a $90.00 bill generates a $00.41 expense for each 30-day grace period. The future value of $90.00 at 5.4% APR for 30-days is $00.41. Thus, the company experiences a cost of $00.41.

On the other hand, if a billing company is able to obtain immediate payment of the $90.00 bill and is not required to use the payment to cover expenses, it can sell the use of that money as commercial paper. Assuming a 5.4% APR for commercial paper the billing company in this case increases its revenue by $00.41 or the future value of $90.00 at 5.4% APR for 30-days. Thus, the 30-day grace period is experienced as the expense of obtaining credit, or the opportunity cost of loosing otherwise available interest payments.

It is, therefore, the object of this invention to create a method by which customers are encouraged to deposit their remittance envelopes for delivery to the billing company as soon as possible after receipt.

Billing Processes

In creating billing procedures a company is faced with a three fold and often conflicting set of goals: prompt and efficient collection of each month's revenue; discouraging delinquent payments for amounts billed; and, maximization of customer satisfaction.

In order to facilitate prompt and efficient collection and deposit of money, companies employ efficient billing processes. An example is automated check reconciliation. In this case, when a billing company receives a remittance payment, the check is automatically and efficiently drafted into the company's account. Such a process can enhance a company's cash flow by quickly depositing the remittance.

Companies also employ negative reinforcement to encourage timely payment. When customers pay their bills late, the billing companies experience even greater cash flow deficits. They are, therefore, forced to rely more heavily on short-term credit to cover operating expenses. Negative reinforcement is designed to discourage late payments of month to month bills. This typically occurs as a flat late charge or a percentage interest charge on the principal amount owed. However, if a bill becomes extremely overdue, a company may have to employ the use of aggressive collection means, such as phone calls and legal action in order to collect overdue amounts.

Prior Solutions

Rarely does a billing process create both prompt and efficient collection while simultaneously enhancing customer satisfaction. For example, most monthly billing companies will include a courtesy pre-addressed remittance envelope with the customer's bill. Although seemingly insignificant, the remittance envelope is accurately addressed and electronically coded to minimize delivery time and maximize process efficiency. The billing company benefits by reducing the amount of payments that would otherwise be late or not delivered at all due to poor addressing. The billing customer benefits by not having to independently buy and address an envelope in order to make payment. Although, a billing customer must still pay for delivery of the payment, process efficiencies such as pre-addressing and bar-coding the remittance envelope for electronic sorting and rapid delivery, decrease the time between billing and remittance. By merely including a pre-addressed and coded remittance envelope a billing company achieves the goal of decreasing collection time and simultaneously enhancing customer satisfaction.

Under current billing practices most companies do not pay for delivery of a customer's remittance. While it is possible for a billing company to pay for delivery of each remittance, the prior art does not include any delivery payment options that encourage early remittance. Without such an option, a billing company does not achieve the benefits from minimizing the period between billing and remittance. For example, the U.S. Postal Service offers Meter Reply Mail. With this product a charge is made to the billing company for each piece of mail upon which postage is attached. Thus, a billing company using this product for remittance pays for all letters regardless of when they are sent. There is no incentive for early remittance.

The U.S. Postal service also offers Business Reply Mail. Under this product, only those pieces of mail actually sent are charged to the billing company. This product does not charge for letters never sent nor does it include any incentive for early customer remittance. The letter is paid for whenever it is used. Thus, Business Reply Mail also does not create any incentive for early remittance.

Expiring Indicia

Therefore, there is a need for a method that encourages monthly billing customers to pay their bills upon receipt or immediately thereafter, while simultaneously increasing customer satisfaction.

By using expiring indicia, customers are encouraged to deposit their remittance soon after it is received.

Expiring indicia are marks or a single mark placed on a delivery piece such as a parcel or envelope. The expiring indicia manifest a set time. When a delivery piece with expiring indicia is deposited for delivery, the delivery system reads the set time. If the delivery piece is placed in delivery and read before the set time, the delivery piece upon which such indicia are attached will be allowed to pass through the delivery system. The billing company, or a third party, pays the cost of delivering this piece. Alternatively, if the remittance envelope is placed for delivery after the set date, the indicia manifesting time is understood to be of no value. The delivery piece is returned for payment by the customer. Thus, the indicia manifesting time expires.

With this feature, billing companies can send out bills to customers with the expiring indicia attached to the remittance envelope. The set time, as part of the expiring indicia, is determined to encourage the billing customer to return payment within a short time after receipt. For example, a customer may receive a bill including an expiring indicia on the remittance envelope on January 1. The indicia on the remittance envelope states that if it is placed in delivery before January 4, the billing company will pay delivery. Customers are, thus, encouraged to promptly deposit their remittance envelope and payment in order to avoid the expense of paying for delivery of the remittance themselves.

On the other hand, if remittance is deposited for delivery after the date specified by the indicia, the payment feature will not work. When placed in a delivery system after this date, the indicia on the remittance is understood to be of no value. The envelope is, thus, rejected from the delivery system and returned to the sender where he or she must affix payment to deliver the envelope.

An expiring delivery stamp is a means of positive reinforcement designed to encourage early payment of monthly bills. The billing customer is urged to make use of the indicia because by placing the bill in delivery before the specified date, the billing customer saves the time and expense of obtaining payment for delivery.

Billing companies benefit from using expiring indicia because such a process decreases the time between billing and receipt of payment. By paying for delivery of a customer's remittance in exchange for early remittance, billing companies profit by avoiding the expense of short-term credit. Alternatively, an early remittance can be used to accrue interest.

For example, assuming expiring indicia is used that costs \$00.35 and produces an immediate payment of 90.00. Also assuming a 5.4% APR interest payment, the company saves \$00.06 in short-term interest expense for the 30-day grace period. That is the future value of \$90.00 for 30 days at 5.4% (\$00.41), less the cost of the expiring indicia (\$00.35).

On the other hand, if the company lends the immediate \$90.00 receipt as 5.4% APR commercial paper it similarly achieves a \$00.06 increase in revenue. Although a small amount, companies with thousands or even millions of customers realize substantial benefits. Use of expiring indicia creates a rare efficiency in billing that maximizes company revenue while simultaneously enhancing customer satisfaction.

This invention is a substantial improvement over the prior art. The prior art does not encourage customers to voluntarily deposit remittances as soon as possible after receipt. This innovation creates a mutual benefit for billing companies and customers that the prior art does not achieve.

Thus, the reader will see that this invention provides an extremely effective method of decreasing the time between billing and remittance by positively reinforcing early return of customer bills.

While my above description contains many specificities these should not be construed as limitations on the scope of the invention, but rather as an exemplification of one preferred embodiment thereof Many other variations are possible.

Accordingly, the scope of the invention should be determined not by the embodiment(s) illustrated, but by the appended claims and their equivalents.

BRIEF DESCRIPTION OF THE INVENTION

DETAILED DESCRIPTION OF THE INVENTION

Figure 1:
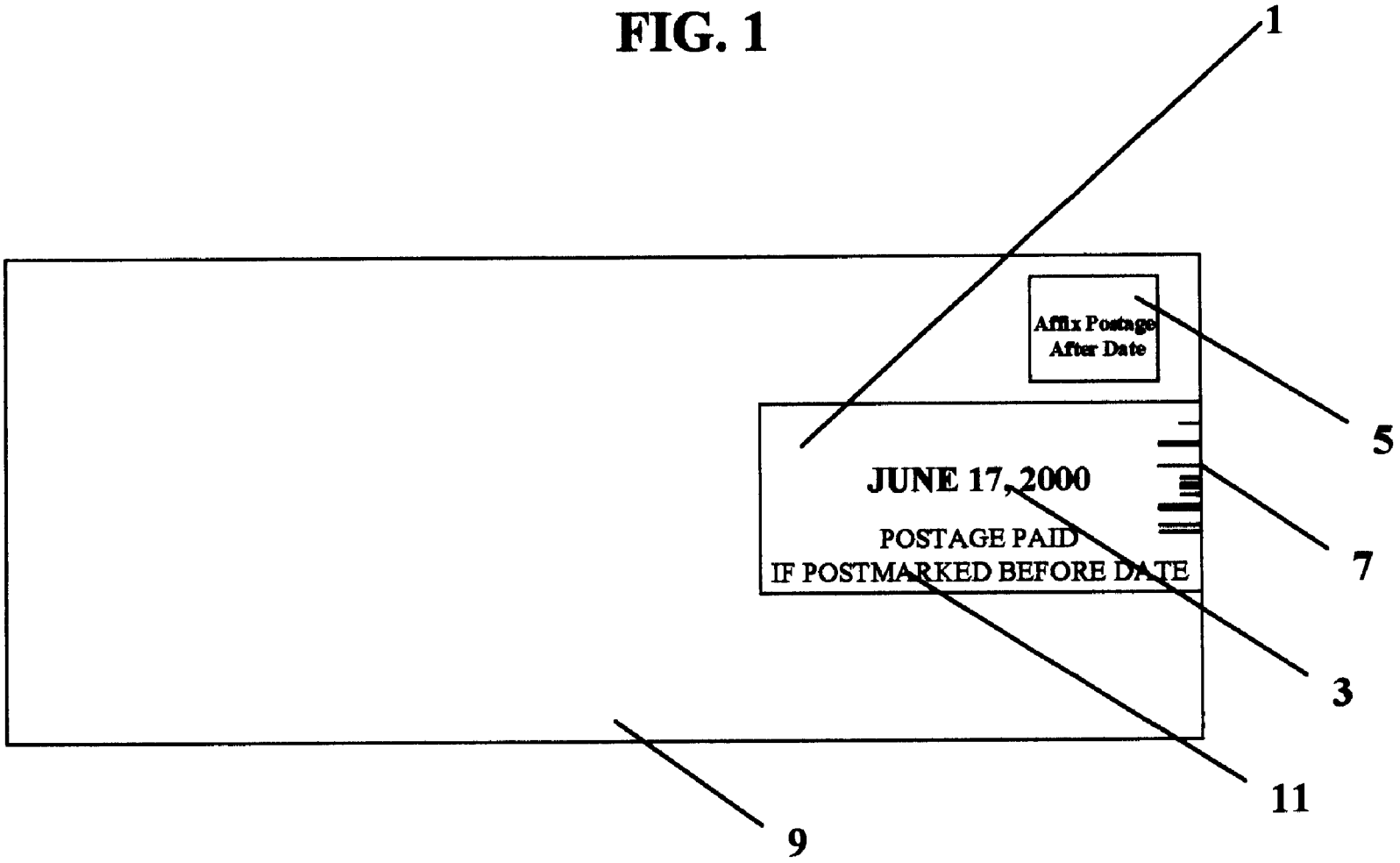
FIG. 1 is a diagram of indicia manifesting time used with the present method as expiring indicia.

FIG. 1 illustrates an example of a delivery piece with indicia manifesting time used in accordance with the claimed method. A delivery piece 9 is illustrated. The delivery piece 9 may be any size or weight. Indicia manifesting time 1, includes a manifested time 3. The indicia manifesting time 1 also include a provision for payment 11 of delivery if postmarked before the manifested time 3. When a user obtains the delivery piece 9 including indicia manifesting time 1, she or he has the option of placing it in a delivery stream before the manifested time 3. When placed in a delivery stream a delivery system with an optional diversion means reads the manifested time 3. The claimed method contemplates use of electronic reading of the indicia such as with bar coding 7. If the delivery piece 9 is placed in a delivery stream and read before the manifested time 3 the delivery system will allow the delivery piece 9 to pass its optional diversion means. However, if the delivery piece 9 is placed in a delivery stream after the manifested time 3 the delivery system is manipulated to divert and not deliver the delivery piece 9. The user must then pay for delivery of the parcel by affixing payment as specified 5. The indicia manifesting time 1, thus, expire with the passage of time and manipulate the delivery system to either continue or divert the delivery piece 9.

Figure 2:
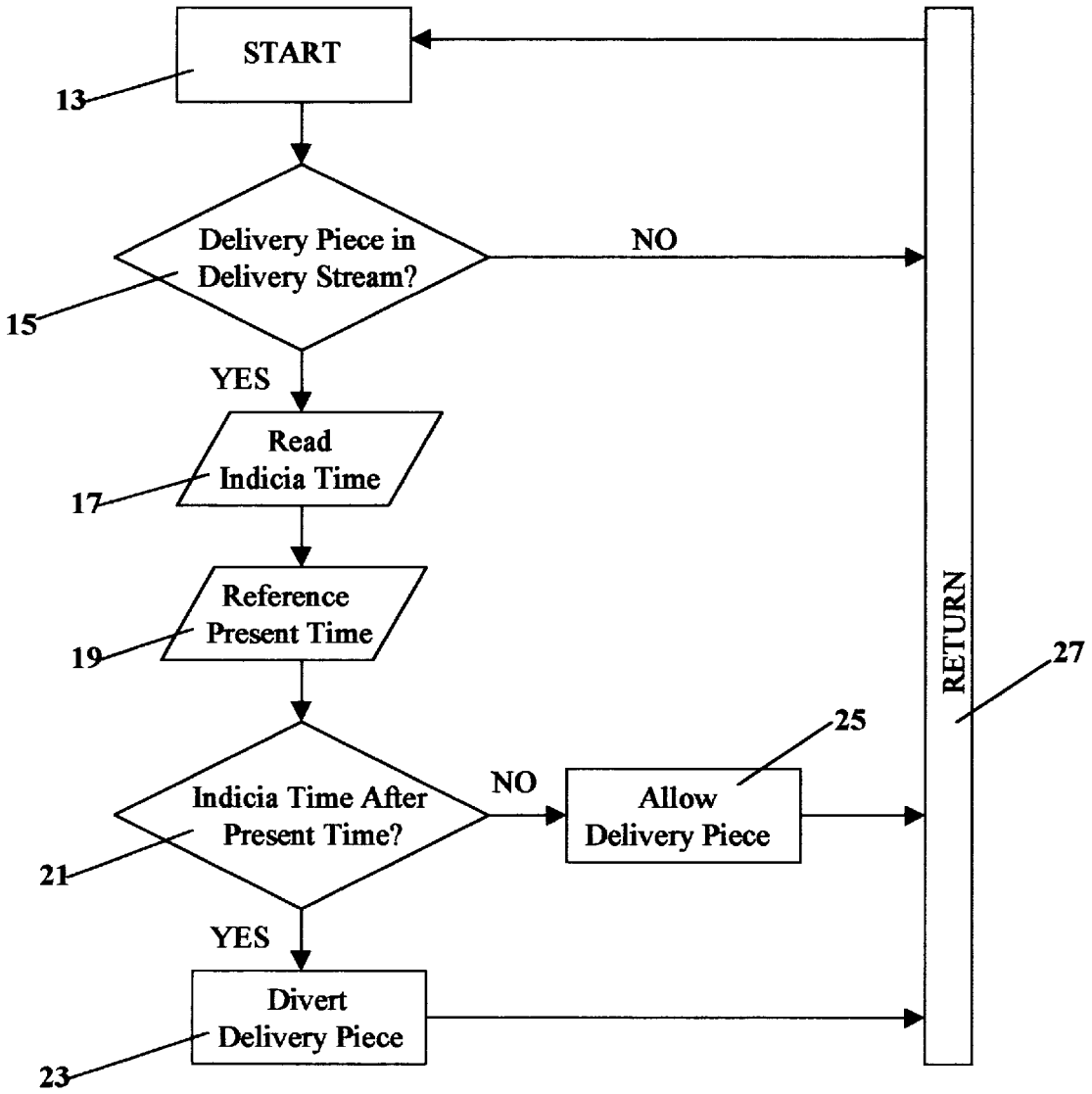
FIG. 2 is a flow chart describing a method of manipulating a delivery system using expiring indicia.

FIG. 2 illustrates a flow chart describing the present invention's method of manipulating a delivery system with optional diversion means to continue or divert a delivery piece from a delivery stream. The process is started as described by operation 13. The method asks whether a delivery piece 9 has been discovered in the delivery stream 15. If the answer is NO, the method returns 27 and starts again 13. However, if a delivery piece 9 has been discovered in the delivery stream, YES, the method requires the action of reading 17 the manifested time 3 specified on the delivery piece 9. The method also requires the action of referencing a present time 19. The method then asks whether the manifested time 3 is after the present time 19. If the answer is YES, the method requires the delivery system to divert 23 the delivery piece. If, however, the answer is NO, the method will manipulate the delivery system with optional diversion means to allow 25 the delivery piece to continue in the delivery stream. The method then returns 27 and begins again 13.

Figure 3:
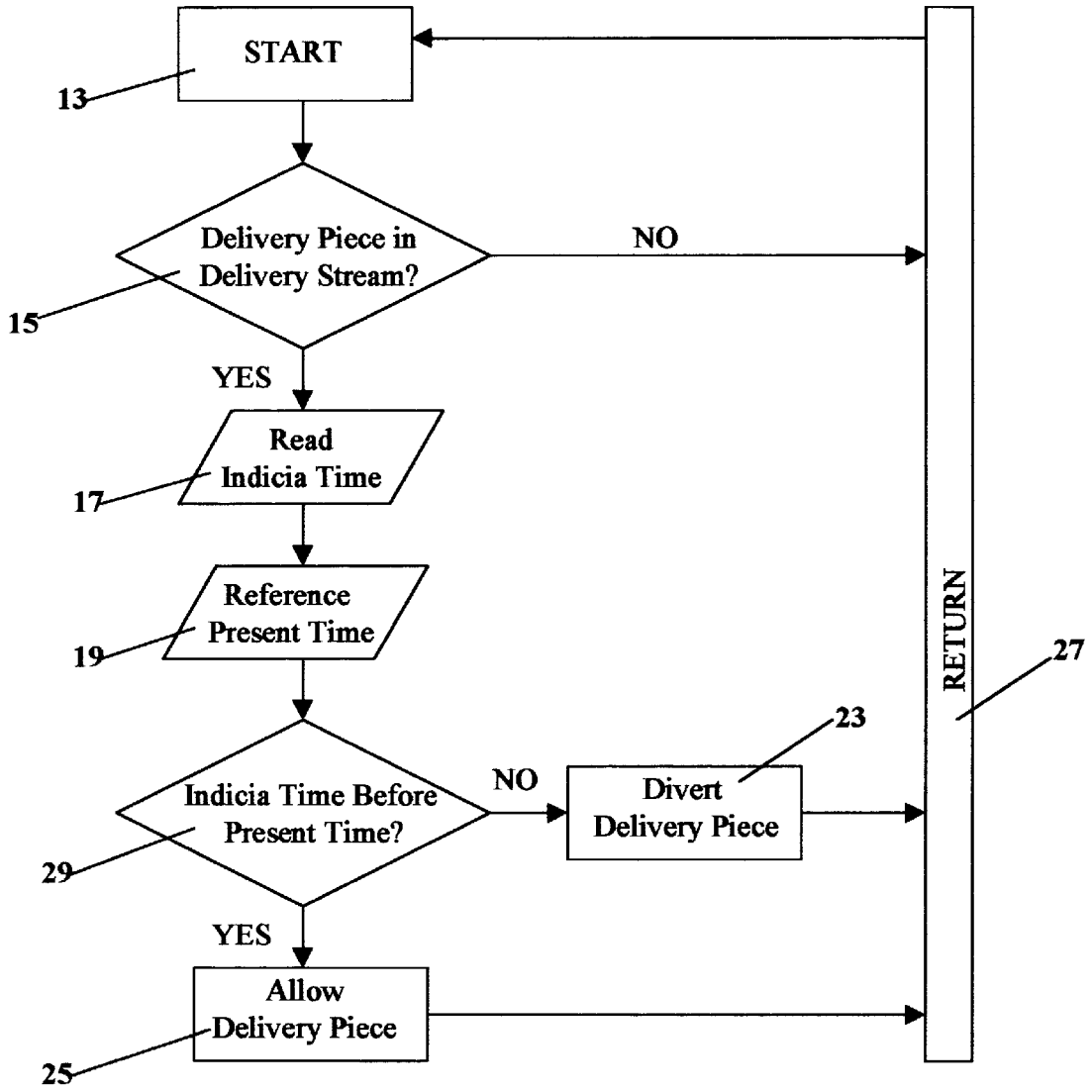
FIG. 3 is a flow chart describing an alternative to the method described in FIG. 2.

FIG. 3 follows the operation of FIG. 2. However, the step asking whether the indicia date is after a present time 21, is varied. FIG. 3 alternatively asks whether the indicia time is before present time 29. If the answer is YES, the method will allow the delivery piece 23. However, if the answer is NO, the method will divert the delivery piece 25. The method then returns to begin again.

SUMMARY

This invention provides a novel method for billing companies to shorten the time between issuance of a bill and the time of remittance. Furthermore, the present invention simultaneously provides a method of positive reinforcement for early remittance of bills. The preferred method consists manipulating a delivery system using of one or a combination of distinctive indicia, such as a stamp, mark, bar code, or other insignia that can be read by human or machine. These distinctive marks include a set date and a provision for payment of delivery prior to the set date. When a delivery piece with indicia placed in a delivery stream the delivery system reads the indicia set date. If this piece is placed in delivery before the date specified, the delivery system is manipulated to allow such a delivery piece to pass. The cost of delivery will be paid by the billing company or a third party, rather than by the sender. However, if the delivery piece is placed in the mail after the indicated time, the delivery system will be manipulated to reject the delivery piece. The parcel is then returned to the customer for payment. Using this method billing companies encourage customers to deposit their remittances early in exchange for payment of delivery.

What is claimed is:

1. A method manipulating a delivery system using indicia manifesting time comprising the steps of:

(a) providing a delivery stream for conveying delivery pieces, (b) receiving a delivery piece in said delivery stream, (c) providing an indicia manifesting time for manifesting time on said delivery piece, (d) providing a reading means for reading a manifested time by said indicia manifesting time, (e) reading said manifested time, (f) providing time means for determining a present time, (g) determining said present time, (h) comparing said manifested time by said indicia manifesting time to said present time, (i) providing a delivery system with optional diversion means to divert said delivery piece in said delivery stream, (j) diverting said delivery piece by said delivery system with optional diversion means when said manifested time by said indicia manifesting time is after said present time whereby, a delivery system is manipulated to divert a delivery piece when deposited after the indicia manifested time.

2. The method of claim one wherein said delivery piece is an envelope.

3. The method of claim one further including a plurality of delivery pieces.

4. The method of claim one wherein said reading means is a bar code reader.

5. The method of claim one further including a plurality of indicia manifesting time.

6. The method of claim one wherein said indicia manifesting time is a bar codeing.

7. The method of claim one wherein said indicia manifesting time is postage.

8. The method of claim one further including a provision for payment of delivery if said delivery piece is deposited for delivery before said manifested time indicated by said indicia manifesting time.

9. The method of claim one wherein said manifested time is displayed symbolically.

10. The method of claim one wherein said delivery system with optional diversion means is a mail sorter.

11. A method manipulating a delivery system with optional diversion means using indicia manifesting time comprising the steps of:

(a) providing a delivery stream for conveying delivery pieces, (b) receiving a delivery piece in said delivery stream, (c) providing an indicia manifesting time for manifesting time on said delivery piece, (d) providing reading means for reading a manifested time on said indicia manifesting time, (e) reading said manifested time on said indicia manifesting time, (f) providing time means for determining a present time, (g) determining said present time, (h) comparing said manifested time by said indicia manifesting time to said present time, (i) providing a delivery system with optional diversion means to allow said delivery piece to continue in said delivery stream, (j) allowing said delivery piece to continue in said delivery stream when said manifested time by said indicia manifesting time is before said present time whereby, a delivery system is manipulated to allow a delivery piece to continue in the delivery stream when deposited before the indicia manifested time.

12. The method of claim eleven wherein said delivery piece is an envelope.

13. The method of claim eleven further including a plurality of delivery pieces.

14. The method of claim eleven wherein said reading means is a bar code reader.

15. The method of claim eleven further including a plurality of indicia manifesting time.

16. The method of claim eleven wherein said indicia manifesting time is a bar coding.

17. The method of claim eleven wherein said indicia manifesting time is postage.

18. The method of claim eleven further including a provision for payment if deposited for delivery before said manifested time indicated by said indicia manifesting time.

19. The method of claim eleven wherein said manifested time is displayed symbolically.

20. The method of claim eleven wherein said delivery system with optional diversion means is a mail sorter.

* * * * *